United States Patent [19]

Suzuki

[11] Patent Number: 5,044,556

[45] Date of Patent: Sep. 3, 1991

[54] WATER SPRAYER FOR WETTING TOILET PAPER

[76] Inventor: Masahiko Suzuki, 896, Nagafusa-cho, Hachioji-shi, Tokyo, Japan

[21] Appl. No.: 460,367

[22] Filed: Jan. 3, 1990

[51] Int. Cl.[5] ..... A47K 7/00; B05B 1/24

[52] U.S. Cl. ..... 239/135; 239/274; 222/183; 401/118; 4/300.1

[58] Field of Search ..... 239/135, 128, 274, 289; 222/146.2

[56] References Cited

U.S. PATENT DOCUMENTS

| | | | |
|---|---|---|---|
| 3,776,773 | 12/1973 | Taft | 4/300.1 |
| 3,947,134 | 3/1976 | Ogawa | 401/118 |
| 4,087,022 | 5/1978 | Zanetti-Streccia | 222/183 |
| 4,451,943 | 6/1984 | Nibler | 239/274 |
| 4,540,489 | 9/1985 | Barnard | 210/435 |

FOREIGN PATENT DOCUMENTS

| | | | |
|---|---|---|---|
| 1261645 | 2/1968 | Fed. Rep. of Germany | 239/274 |

*Primary Examiner*—Andres Kashnikow
*Assistant Examiner*—Lesley D. Morris

[57] ABSTRACT

In the sprayer for wetting toilet paper of the present invention, the water in the tank having the water feeding and the water exhalant ports is kept its temperature by the heater and the means for controlling the temperature. The water warmed spouts out from the nozzle connected to the tank toward toilet paper. With this wetted and warmed toilet paper, the anal region can be kept clean after moving the bowels. The device is especially effective for victims of piles.

12 Claims, 4 Drawing Sheets

WATER SPRAYER FOR WETTING TOILET PAPER

FIELD OF THE INVENTION AND RELATED ART STATEMENT

The present invention relates to a water sprayer for wetting toilet paper.

After moving the bowels, we clean the anal region with toilet paper for personal cleanliness. However, in case of using dry toilet paper, it is uncomefortable to wipe feces off from the region. It is especially painful for victims of piles to wipe the anal region with dry toilet paper. To lessen the pain, some victims use wet tissue paper but wet tissue paper cools the region, and the condition becomes worse.

Recently, a shower-toilet has appeared. It has a water pump and a nozzle. After moving the bowels, user operates the pump to spout out warm water toward his anal region. Extraneous feces on the region are washed off by the water spouted and the region is kept clean. However, this shower-toilet is expensive and cannot be set up without a sewer system or purifier.

OBJECT AND SUMMARY OF THE INVENTION

The object of the present invention is to provide an inexpensive water sprayer for wetting toilet paper which can wet toilet paper with warm water to improve the cleaning effect.

To achieve the object, the water sprayer of the present invention has the following structure. Namely, the structure of the water sprayer includes a tank having a feeding port and an exhalant port, a heater for heating up the temperature of water in the tank, means for controlling the heater to keep the temperature of the water heated to a prescribed temperature, a nozzle for spouting warm water to wet tiolet paper, connected to the exhalant port of the tank, and a valve for opening and closing the nozzle.

With the sprayer of this structure, the water introduced in the tank via the feeding port is heated by the heater, which is controlled by the means for controlling the heater, up to prescribed temperature. When the valve opens the nozzle, the warm water spouts therefrom. Toilet paper can be wetted by the warm water.

In the sprayer of the present invention, toilet paper can be wetted, so that extraneous feces on the anal region can be wiped off effectively after moving the bowels. The toilet paper is warmed by the water, so irritation to the anal region can be softened and the region can be warmed up. Even victims of piles can use toilet paper comfortably. The sprayer is inexpensive bcause of its simple structure. Further, the sprayer can be set up in any toilet without a sewer system or a purifier.

BRIEF DESCRIPTION OF THE DRAWINGS

The present invention will be apparent from the following description, reference being had to accompanying drawings wherein a preferred embodiment of the present invention is clearly shown.

In the drawings.

DETAILED DESCRIPTION OF THE PREFERRED EMBODIMENTS

A preferred embodiment of the present invention will now be described in detail with reference to the accompanying drawings.

Figure 1:
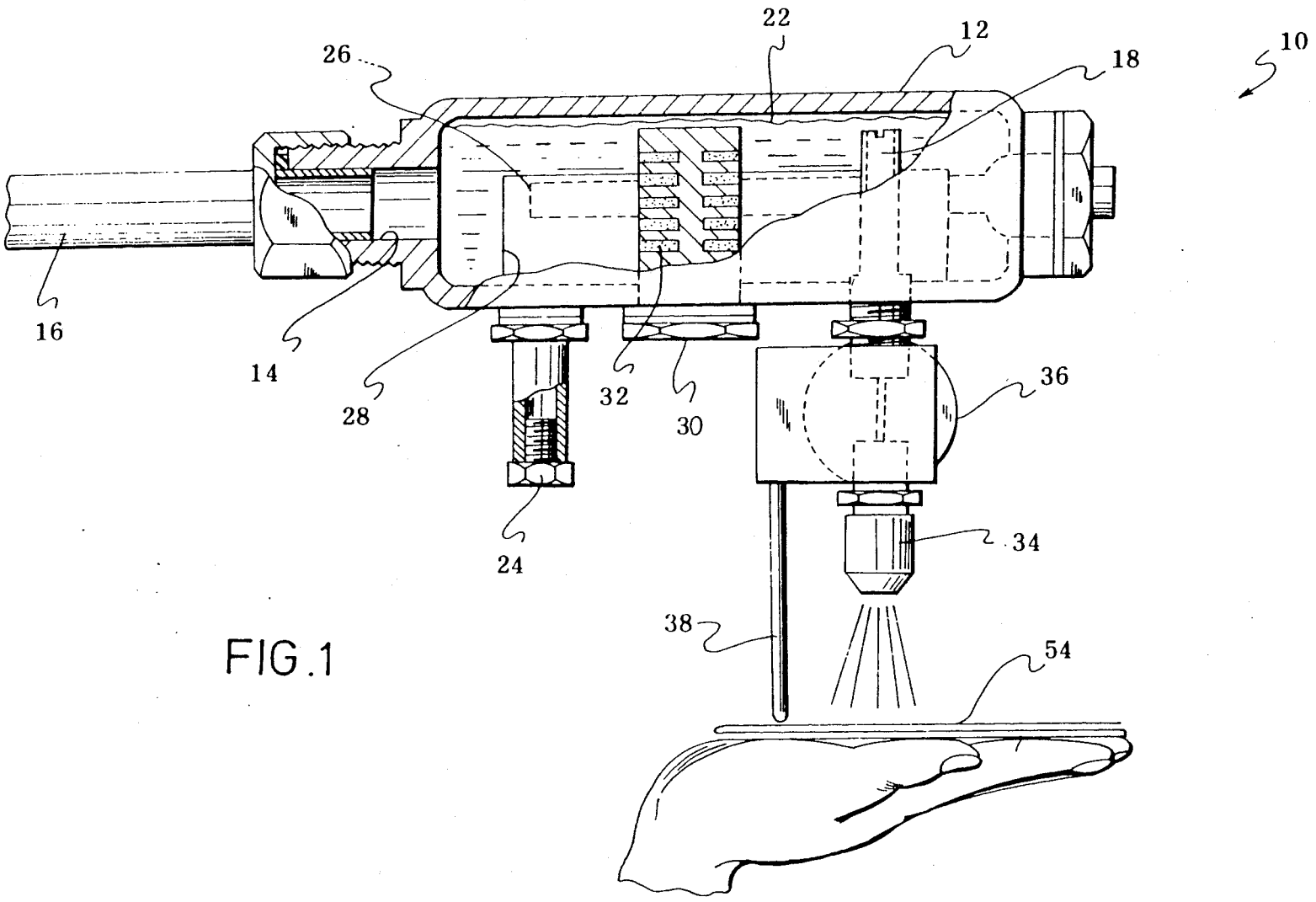
FIG. 1 shows a partially cutaway front view of the water sprayer for wetting toilet paper of the present invention.
Figure 2:
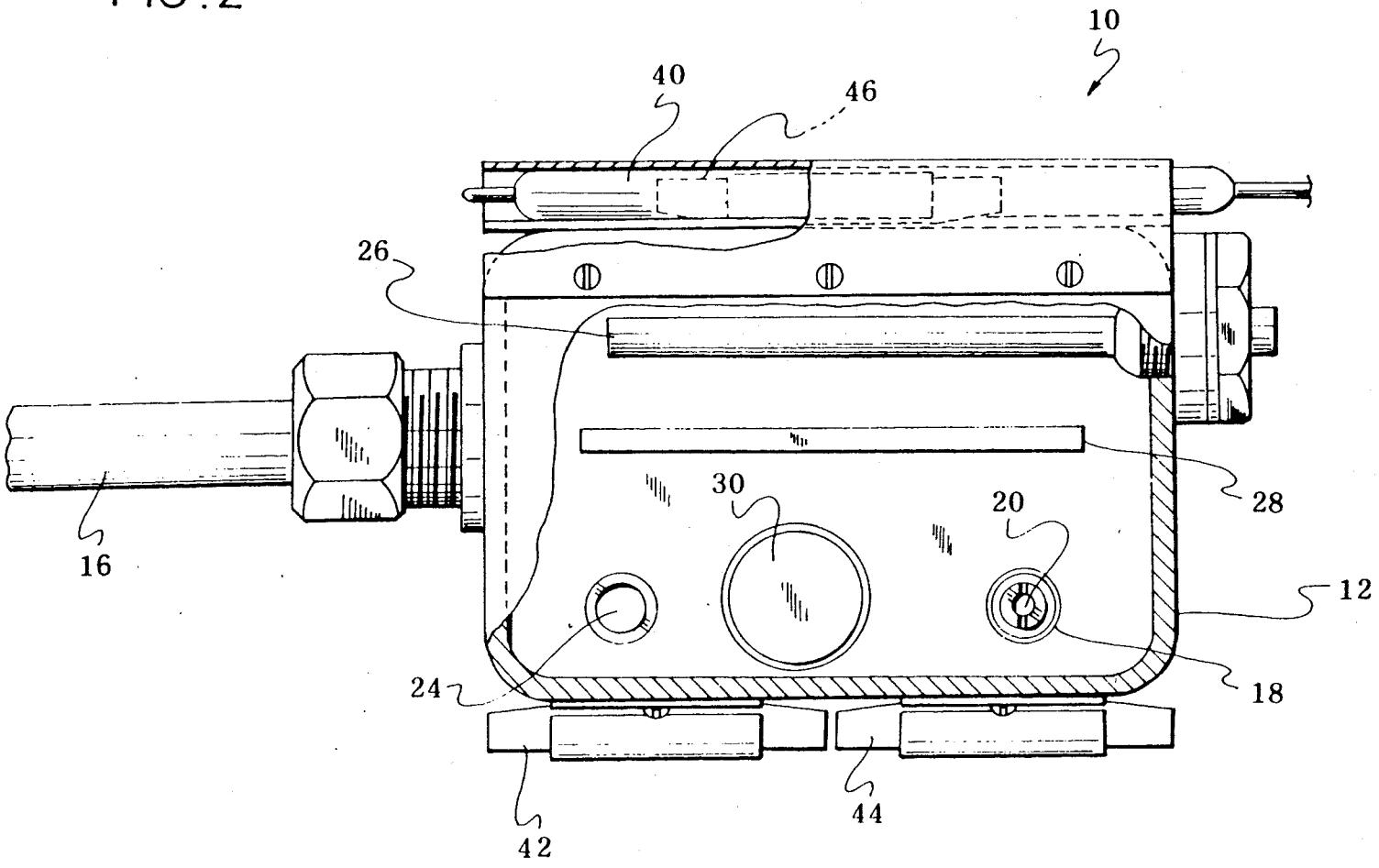
FIG. 2 shows a partially cutaway plan view thereof.
Figure 3:
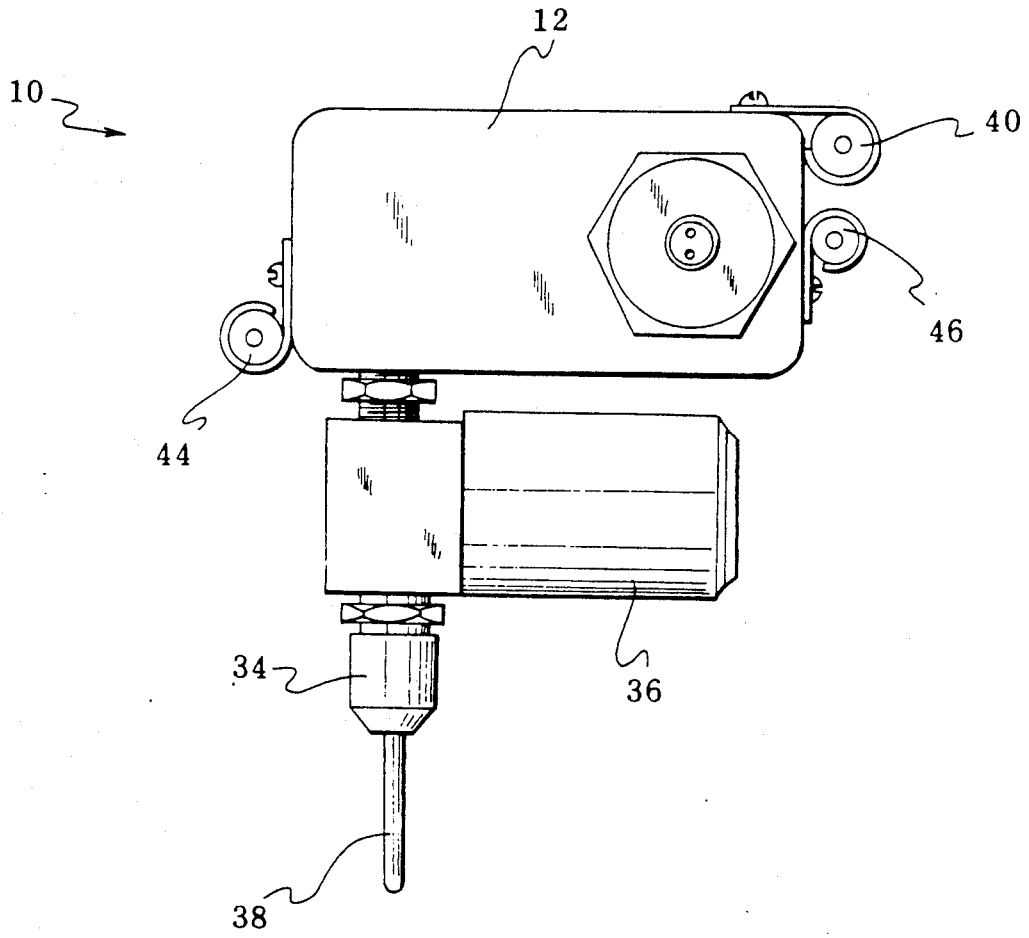
FIG. 3 shows a side view thereof.

First, the structure of the sprayer 10 will be explained with reference to FIGS. 1–3.

A pipe 16 is screwed in a feeding port 14 of a tank 12. Water is introduced in the tank 12 via the pipe 16. An exhalant pipe 18 is provided in the tank 12 and whose lower end section is screwed to attach to the bottom part of the tank 12. The lower end opening of the exhalant pipe 18 is the exhalant port of the tank 12. There is a little gap between the top end of the exhalant pipe 18 and the upper inner face of the tank 12, so that the air in the tank 12 can be introduced out of the tank 12 earlier than the water 22 therein. A heater 26 is usually located in the water 22.

A drain screw 24 is provided to drain the water 22 in the tank 12. It is detached from the tank 12 when the inner part of the tank 12 is washed or in case the sprayer 10 is not used for a long time.

The heater 26 is a rod-type sheath heater. It heats up the water 22 in the tank 12. The upper most part of the heater 26 is usually below the water surface because, as described above, the top end of the exhalant pipe 18 is located higher than the upper most part of the heater 26.

An activating section 30 is provided in the tank 12 to activate the water 22. There are activators 32 such as active carbon, porous ceramic pieces, active stone (Bakuhan-seki), ect. in the activating section 30 to contact water 22.

A nozzle 34 is connected to the lower end section of the exhalant pipe 18. The water path in the nozzle 34 is opened or closed by an electromagnetic valve 36. The eletromagnetic valve 36 is switched by pushing a switching piece 38 upward.

There is provided an extended plate 28 in the tank 12. It is extended upward from the inner bottom face of the tank 12, and there is a prescribed clearance between the heater 26 and the extended plate 28. The extended plate 28 is provided for operation of means for controlling the temperature of the water 22.

Next, the means for controlling (not shown in FIG. 1) which is a thermo-controller, includes a gas-expansion switch 40 which turns off by expanding gas therein, heat-sensing switches 42, 44 and 46 which are heatsensing reed switches, and which turn on and off at prescribed temperatures.

The heater 26 is electrically connected to the means for controlling to keep the temperature of the water 22 in the tank 12 at a prescribed temperature. Note that, the switch 42 turns the heater 26 off when the surface temperature of the tank 12 reaches 45° C., and the switch 44 turns the heater 26 off when the surface temperature of the tank 12 reaches 55° C. This setting temperature of switches 42 and 44 is set by a setting switch (not shown) provided on the tank 12 to choose the temperature of the water 22 in the tank 12. The switch 46 is provided to prevent overheating. When the switch 42 is working, the switch 46 changes working switch 42 to 44 when the switch 46 senses the surface temperature of the tank 12 reaches 50° C. The gas-expansion switch 40 turns the heater 26 off when the surface temperature of the tank 12 reaches 60° C. to prevent overheating.

Note that the switches are not limited to the above described type switches. They may be any type of heat sensitive switches.

Next, the action of the sprayer 10 will be described.

When the switching piece 38 is not pushed, the electromagnetic valve 36 closes the nozzle 34.

First, the temperature of the water 22 is set, for example, at 45° C. by the setting switch (not shown) then switching temperature of switches 42 and 44 is also set. The electric current passes the heater 26 and the heater 26 heats up the water 22, which has been introduced in the tank 12 via the pipe 16 and the feeding port 14. When the surface temperature of the tank 12 reaches 45° C., the switch 42 turns the heater 26 off. When the surface temperature of the tank 12 falls down from 45° C., the switch 42 turn the heater 26 on again. Therefore, the temperature of the water 22 can be kept at about 45° C.

When using the sprayer 10, the user folds toilet paper 54 to a proper thickness and supports it on his hand. Next, the toilet paper 54 should be located immediately below the nozzle 34, then user pushes up the switching piece 38 to turn the electromagnetic valve 36 on so as to open the nozzle 34. Upon turning the electromagnetic valve 36 on, the warm water 22 in the tank 12 sprays out from the lower end of the nozzle 34. The water 22 is pushed out via the exhalant pipe 18 by the water pressure in the tank 12.

The toilet paper 54 is wetted and warmed by the warm water sprayed. Wetted toiled paper 54 becomes soft to the touch. Therefore, the user uses the toilet paper 54 comfortably.

Next, overheating prevention will be described.

As described above, the sprayer 10 has the means for controlling the temperature. In case the setting temperature of the water 22 is 45° C., the switch 42 turns the heater 26 off when the surface temperature of the tank 12 is 45° C. However, if there is little or no water in the tank 12, the switch 46 senses 50° C. before the switch 42 senses 45° C. The reason is that there is a space, which is rounded by the extended plate 28 and the inner faces of the tank 12, in the tank 12, and the heater 26 is located in the space, so that the air in the space is heated earlier than other parts of the tank 12. Therefore, the switch 46, which is provided on the outer face adjacent to the space, senses 50° C. before the switch 42 senses 45° C. Namely, the time lag of heat conduction causes the difference of the surface temperature.

If the switch 46 senses 50° C. before the switch 42 senses 45° C., the switch 46 changes from switch 42 to 44. In a normal operation, the heater 26 is turned off when the switch 44 senses 55° C., but the gas-expansion switch 40 reaches 60° C. before the switch 44 senses 55° C. by the time lag of heat conduction in the case of little or no water in the tank 12, then the gas-expansion switch 40 turns the heater 26 off. Therefore, the switch working is changed at 50° C., so that heating an empty tank and unnecessary switching of the heater 26 at 45° C. are prevented.

In a cold district, an antifreezing valve is used in a water conduit. When the antifreezing valve is closed, the water in the pipe 16 is drained out, so that the air pressure in the pipe 16 becomes negative with respect to the pressure in the tank 12. In this status, if the electromagnetic valve 34 is opened, the pressure of the atmosphere works in the tank 12, so that the water 22 in the tank 12 is drawn toward the pipe 16 and the tank becomes empty.

Figure 4:
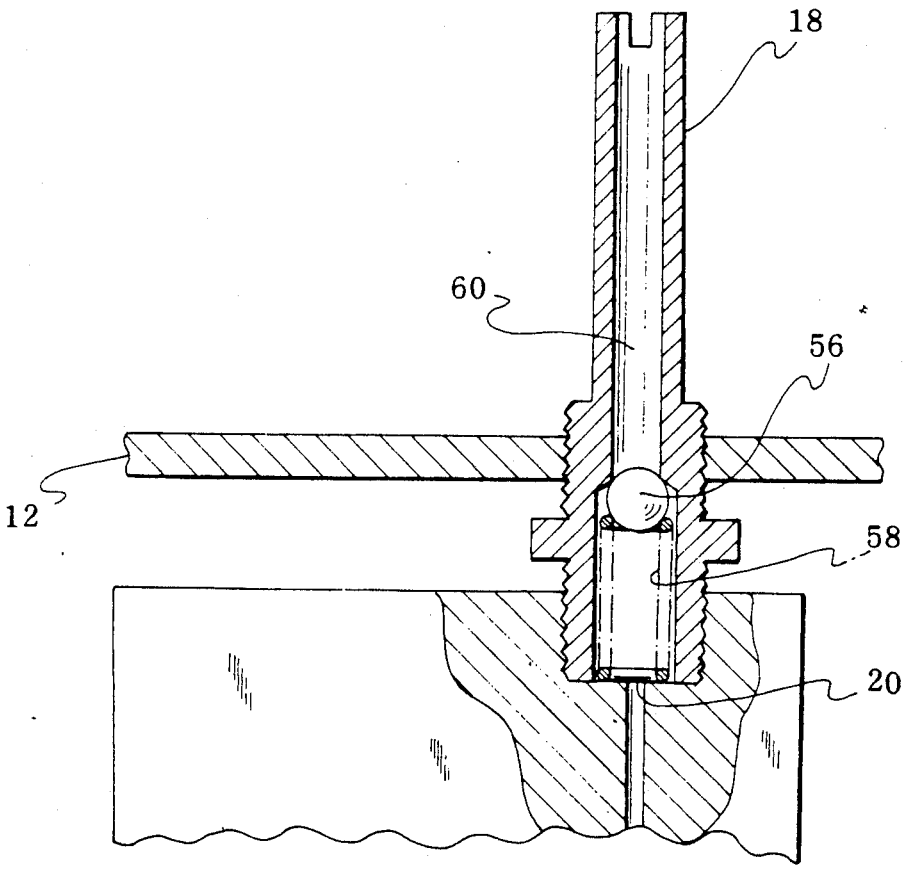
FIG. 4 shows an explanation view of a check valve provided in the tank.

To prevent this suction, there is provided a check valve comprising a metal ball 56 and a spring 58 midway in the water path 60 of the exhalant pipe 18 as shown in FIG. 4. The ball 56 is always biased upward to close the water path 60 by elasticity of the spring 58, so that the air pressure of the atomosphere cannot work in the tank 12 even if the air pressure in the pipe is negative, and the water 22 in the tank 12 is not sucked toward the pipe 16. Note that, the elasticity of the spring 58 should be smaller than water pressure working in the tank 12, and the check valve may be provided in the nozzle 34.

A preferred embodiment of the present invention has been described in detail. The present invention is not limited to the above described embodiment and many modifications can be allowed without deviating the spirit of the invention.

What is claimed is:

1. A water sprayer for wetting toilet paper comprising:

a tank having a water feeding port and a water exhalant port;

a heater for heating the water in said tank;

means for controlling the temperature of the water heated by said heater;

a nozzle, which is connected to the water exhalant port of said tank, for spraying water toward toilet paper;

a valve for opening and closing the water path in said nozzle;

an exhalant pipe whose lower end section is connected to said tank, and whose upper end is said exhalent port which is located higher than the upper most section of said heater.

2. A water sprayer for wetting toilet paper according to claim 1, further comprising a water activator in said tank.

3. A water sprayer for wetting toilet paper according to claim 1, further comprising a check valve between the nozzle and said tank wherein said tank includes an inner wall.

4. A water sprayer for wetting toilet paper according to claim 2, further comprising a check valve between the nozzle and said tank wherein said tank includes an inner wall.

5. A water sparyer for wetting toilet paper according to claim 1, wherein said means for controlling is a thermo-controller, which is composed of a gas-expansion switch and a heat-sensing switch, so as to prevent overheating of the water in said tank.

6. A water sprayer for wetting toilet paper according to claim 1, wherein means for controlling is a thermo-controller including means for sensing the temperature in said tank, said means for sensing being extended from an inner wall of said tank so as to conduct heat in said tank to said thermo-controller.

7. A water sprayer for wetting toilet paper according to claim 2, wherein said means for controlling is a thermo-controller, which is composed of a gas-expansion switch and a heat-sensing switch, so as to prevent overheating of the water in said tank.

8. A water sprayer for wetting toilet paper according to claim 2, wherein said means for controlling includes means for sensing the temperature is said tank, said means for sensing being extended from an inner wall of said tank so as to conduct heat in said tank to said means for controlling.

9. A water sprayer for wetting toilet paper according to claim 3, wherein said means for controlling is a thermo-controller, which is composed of a gas-expansion switch and a heat-sensing switch, so as to prevent overheating of the water in said tank.

10. A water sprayer for wetting toilet paper according to claim wherein said means for controlling includes means for sensing the temperature in said tank, said means for sensing being extended from the inner wall of said tank so as to conduct heat in said tank to said means for controlling.

11. A water sprayer for wetting toilet paper according to claim 4, wherein said means for controlling is a thermo-controlled, which is composed of gas-expansion switch and a heat-sensing switch, so as to provent overheating of the water in said tank.

12. A water sprayer for wetting toilet paper according to claim 4 wherein said means for controlling includes means for sensing the temperature in said tank, said means for sensing being extended from the inner wall of said tank so as to conduct heat in said tank to said means for controlling.

* * * * *